US005637388A

United States Patent [19]

White et al.

[11] Patent Number: 5,637,388

[45] Date of Patent: Jun. 10, 1997

[54] LAYERED RESINOID/DIAMOND BLADE FOR PRECISION CUTTING OPERATIONS AND METHOD OF MANUFACTURING SAME

[75] Inventors: Robert M. White, Rochester; Robert P. Altavela, Farmington; Alex S. Brougham, Rochester; Lawrence H. Herko, Walworth; Robert A. Clingerman, Seneca Falls, all of N.Y.

[73] Assignee: Xerox Corporation, Stamford, Conn.

[21] Appl. No.: 520,065

[22] Filed: Aug. 28, 1995

[51] Int. Cl.[6] ..... B24D 3/02

[52] U.S. Cl. ..... 428/109; 428/408; 428/323; 428/327; 428/110; 51/297; 442/391

[58] Field of Search ..... 428/408, 323, 428/327, 245, 289, 290; 51/297

[56] References Cited

U.S. PATENT DOCUMENTS

| | | | |
|---|---|---|---|
| 3,793,783 | 2/1974 | Paternno, Jr. et al. | 51/206 NT |
| 4,671,021 | 6/1987 | Takahashi et al. | 51/204 |
| 5,313,742 | 5/1994 | Corcoran, Jr. et al. | 51/206 R |

*Primary Examiner*—Archene Turner

[57] ABSTRACT

A composite resinold/graphite/diamond blade is described having enhanced precision cutting properties. The blade is made by assembling several layers, each layer comprising a veil of non-woven graphite fabric impregnated with a mixture of diamond particles blended into a phenolic resin. Layers are built up in sandwich fashion. In one embodiment described, four layers are formed and, in a heating compression molding operation, the sandwich is compressed into a composite blade having a diameter of 4.7 inches with a thickness of 0.011 inch. The final blade is formed by a die cut and lapping process. The layered construction yields a blade with more consistent cross-section and improves blade wear symmetry. In another embodiment, the layers are tailored to have a grit concentration of the diamond/resin mixture at the periphery or cutting edge.

8 Claims, 4 Drawing Sheets

LAYERED RESINOID/DIAMOND BLADE FOR PRECISION CUTTING OPERATIONS AND METHOD OF MANUFACTURING SAME

BACKGROUND AND MATERIAL DISCLOSURE STATEMENT

This invention relates to a precision cutting of discrete devices such as, for example, ink jet printheads and, more particularly, to a resinold/diamond dicing blade used for said precision cutting and a method of making the blade.

There are many prior art discrete devices which are formed as a plurality of substrates integrally formed in a wafer or the like in which require intermediate cuts and/or separation into individual subunits is a last step in the fabrication process. Examples of such discrete devices are ink jet printheads, magnetic heads, and semiconductor sensor devices. Most, but not all, of the devices are formed in silicon-based wafers. A preferred technique for separating the sub-units is to saw through the wafer in a procedure referred to as "dicing". The device used to perform the cutting is referred to as a dicing blade or dicing saw. For cutting operations requiring high precision (±0.5 micron) resinold/diamond blades have been preferred, especially in the production of thermal ink jet printheads, because they form precisely placed, smooth chipless cuts. Prior art resinoid/diamond blades have been typically constructed of a resin-diamond blend. For example, a resinold/diamond blade is disclosed in U.S. Pat. No. 4,878,992 which is constructed of a relatively hard, dense resin bonded material and a 60 to 90% concentration of natural or synthetic diamonds. Other resinold/diamond blades and their use are disclosed in U.S. Pat. Nos. 5,160,403, 5,266,528 and 4,851,371.

These prior art resinold/diamond blades still suffer from performance variability manifested in the asymmetric wear of the blade periphery and shortened blade life due to chipping caused by the forces generated when pieces of silicon or diamond particles loosened from the dicing blade become jammed between the rotating dicing blade and the silicon wafers being cut. The use of natural or synthetic diamonds also adds to the expense.

It is therefore one object of the present invention to provide a resinold dicing blade which produces consistent precision cuts with reduced chipping. It is a further object to provide a resinold blade with increased life. It is another object to provide a resinold/diamond blade which is less expensive than prior art blades without sacrificing precision cutting characteristics. It is also an object to provide an electrically conductive blade to enable automatic blade height sensing on the dicing saw. These and other objects, are obtained by constructing a resinold/diamond blade with a plurality of graphite veil layers impregnated with a resin/diamond blend mixture. A layered construction yields a blade with more homogeneous cross-section reducing the potential for asymmetric wear. Further material savings are realized when the diamond filled resin is used only near the periphery of the blade (about 0.100 inch of the outer diameter is actually used). Other advantages of using the impregnated graphite layer are: enhanced design freedom in use of larger grit sizes for inner layer for faster cutting and finer sizes on the outside. Graphite is electrically conductive enabling ongoing blade height checks during the sawing sequence, e.g., monitoring wear, blade life. Also, graphite has a high modulus of elasticity and therefore helps to provide blade stiffness in cross-section.

SUMMARY OF THE INVENTION

In sum the present invention relates to a layered graphite resinold sawing blade and to a method for manufacturing such a blade. More particularly, the blade is a multi-layered dicing blade comprising a ring shaped veil of a non-woven fabric material permeated with a mix of diamond particles blended into a phenolic resin to form a first layer of said multi-layered blade and at least a second layer overlying said first layer, said second layer constituting a non-woven fabric material permeated with a mix of diamond resin blend into a phenol resin, said first and second layers compressed to form a composite multi-layer graphite/diamond/resin blade having a diameter of between 2–5 inches and a thickness of at least 5 mils. A process for making the blade of the invention includes the steps of forming a diamond and resin blend, forming a first layer of said multi-layered blade by impregnating a first unwoven veil material of a desired circular configuration with said diamond and resin blend, forming at least a second layer by overlying said first layer with a second veil of the same material and impregnating said second layer with said diamond/resin mixture and heating and compressing said at least first and second layer during a mold cycle to form said multi-layer blade.

DESCRIPTION OF THE INVENTION

The resinold/diamond dicing blade of the present invention is especially useful for separating silicon wafers into a plurality of printheads. U.S. Pat. No. 5,306,370 whose contents are hereby incorporated by reference, show in FIG. 3 a dicing blade 10 cutting through a bonded pair of silicon substrates during a thermal ink jet printhead manufacturer. Blade 10 is disclosed as a resinold/diamond blade with the characteristics detailed in column 7, lines 15–23. The dicing blade of the present invention, described in detail below, can be used to saw bonded wafers of the type disclosed in the patent, although its utility extends to other dicing and cutting operations involving other types of silicon-based materials.

EXAMPLE

Figure 1:
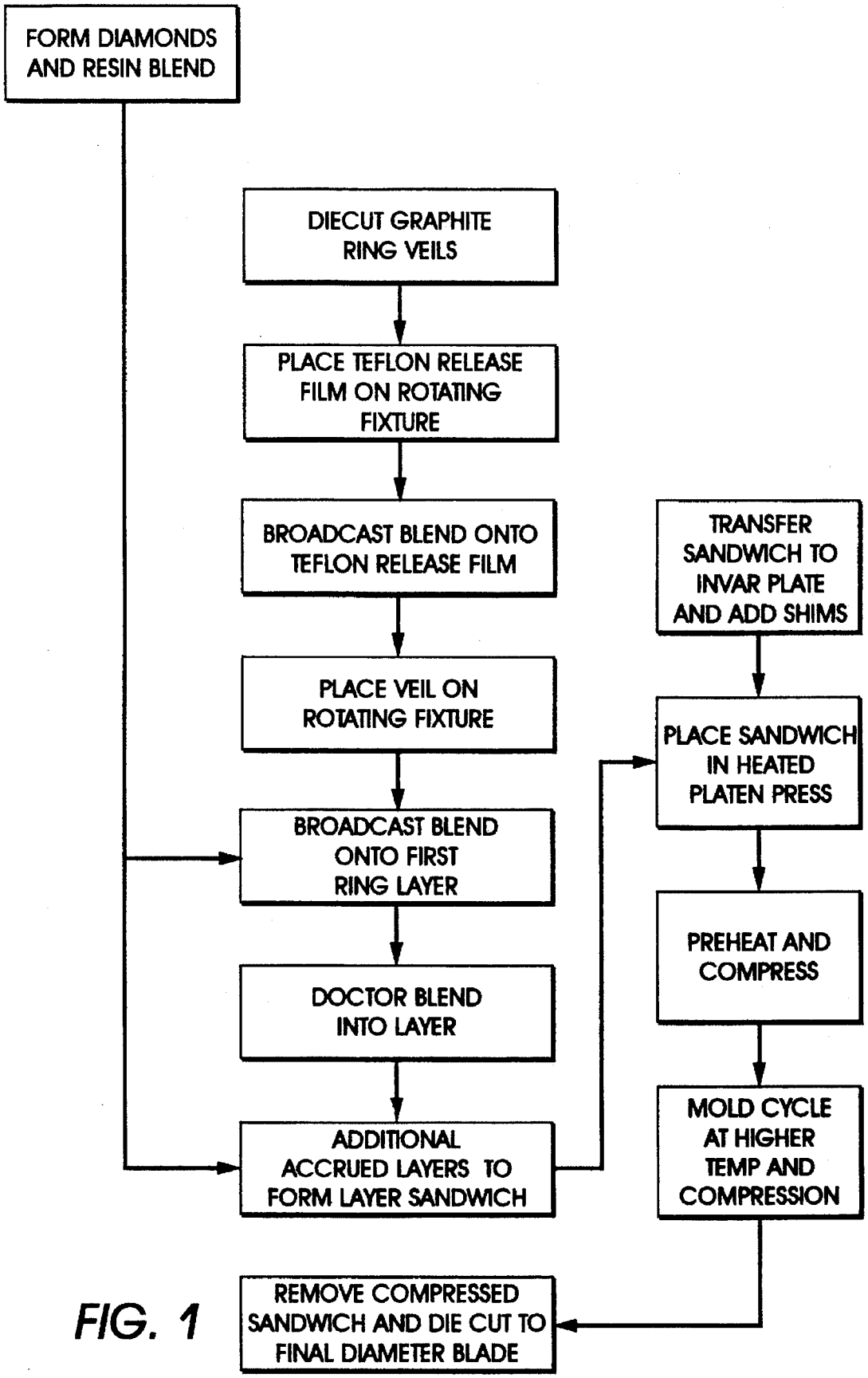
FIG. 1 is a flow diagram illustrating the process steps in making a layered graphite resinold/diamond blade.

Referring to FIG. 1, a diamond resinold dicing blade, according to the invention is made by the following process.

1. Fine diamond particles of a mean particle size of 6.0 microns are blended into a phenolic resin by rolling a ½ full jar for about ½ hour. The resin to diamond mixture is 4 grams/resin to 6 grams/diamond, but this ratio can be varied. The diamond and the resin are different colors so color can be used to evaluate the mixing.

2. Using a steel-rule die, cut to size (outside and inside diameter) a first ring layer of a ¾ oz./sq. yd. unwoven graphite veil material.

3. Place a Teflon release film on a rotating broadcast fixture.

4. While fixture is rotating, broadcast about 0.6 gram of the diamond/resin blend onto the release film.

5. Place the first ring graphite layer on the first blend layer. Then broadcast a second diamond/resin blend onto the first graphite layer to form a light coating thereon. A funnel is a convenient mechanism for this step and has the added advantage of allowing differential deposition of the blend e.g., more of the blend can be deposited towards the periphery of the layer and less towards the center of the layer.

6. Using a doctor blade or the like, doctor the diamond/resin coating into the interstices of the graphite layer until the veil is fully loaded.

7. Repeat steps 2–6 to form a sandwich construction of up to four layers of graphite with doctored in diamonds/resin blending, each layer overlying a previously formed diamond/resin blended graphite layer.

8. Transfer the sandwich to an Invar platen using a teflon film ring for release. An Invar platen is characterized as a low expansion nickel alloy.

9. Place shims at five locations diagonal in four corners and one central to the Invar platen.

Figure 2A:
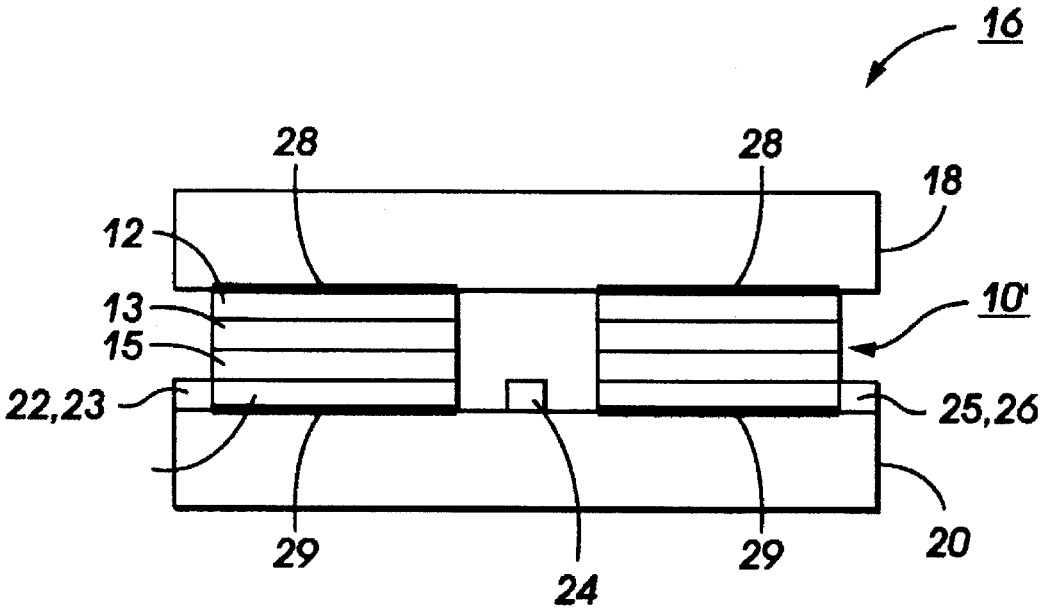
FIG. 2A shows a multi-layered graphite resinold/diamond sandwich in a heated pressure platen.

10. Place the sandwich between preheated platens of a heated platen press. FIG. 2A shows the process up to this point. A sandwich 10, comprising 4 graphite/diamond/resin layers 12–15 is placed between a platen press 16 comprising heated platens 18 and 20. Layers 12 and 15 contact Teflon release films 28, 29. Shims 22–26 are placed as shown. Each shim is approximately 0.011 inch thick.

Figure 2B:
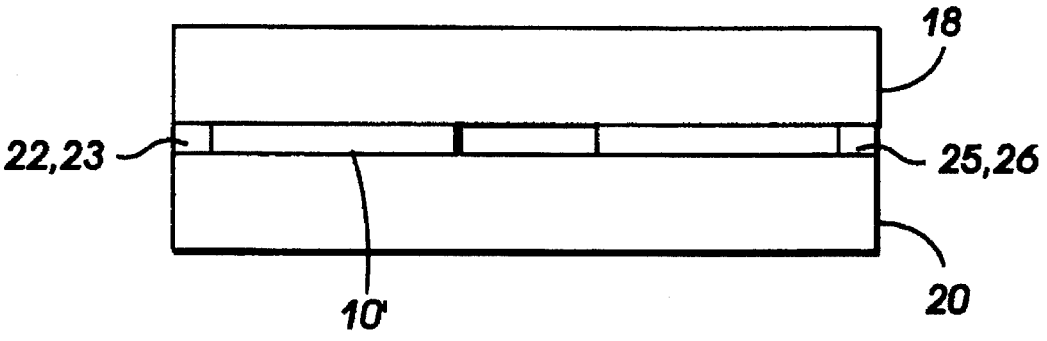
FIG. 2B shows the sandwich of FIG. 2A following heating and compression.

11. Heat the platens to 225° F. and press together for two minutes with a compression force of 2K lb. A mold cycle is then implemented with the temperature raised to 225° over a cycle time of ten minutes and the compression is increased to 40K lb. The shims 22–26 determine the thickness t of the compressed layers, e.g. the thickness following compression of the layers 12–15 would be 0.011 inch. FIG. 2B shows the compressed sandwich 10'.

Figure 3:
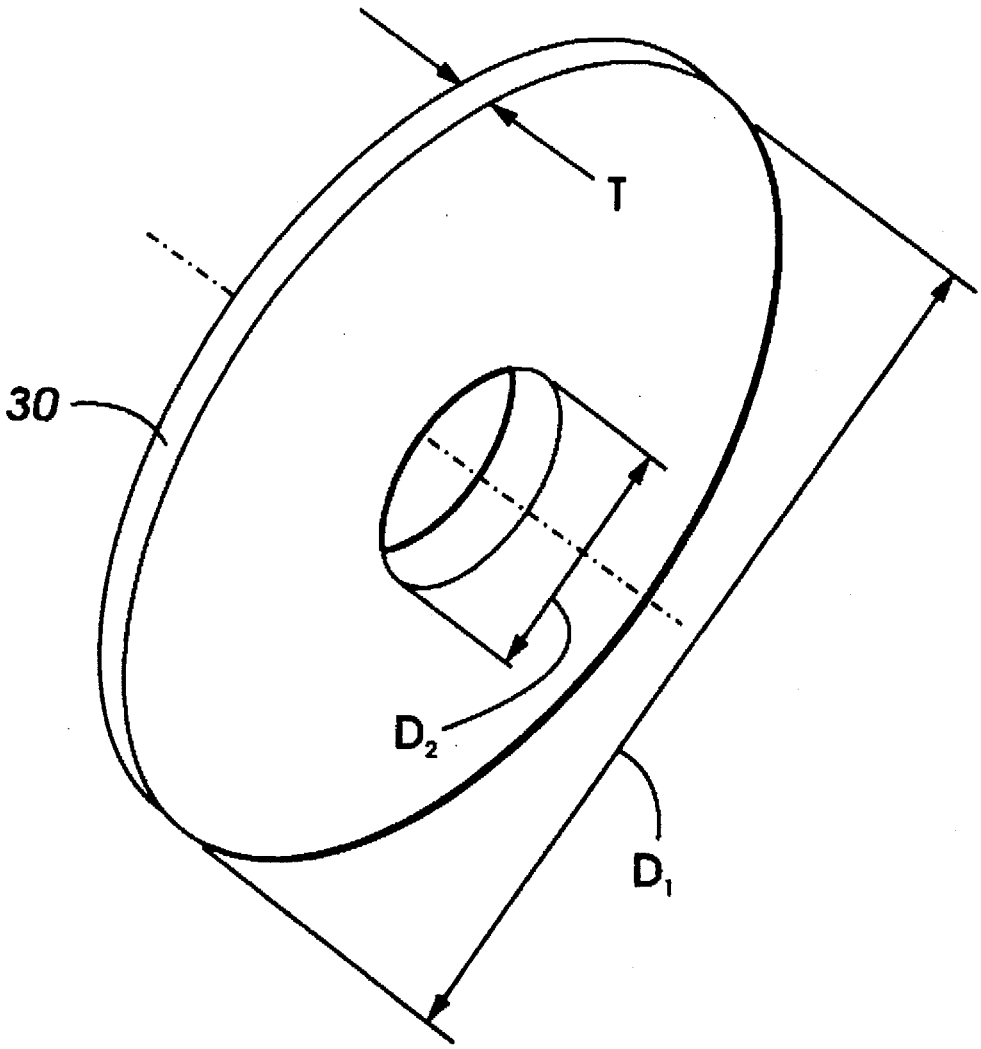
FIG. 3 shows a finished blade following the process steps of FIG. 1.
Figure 4A:
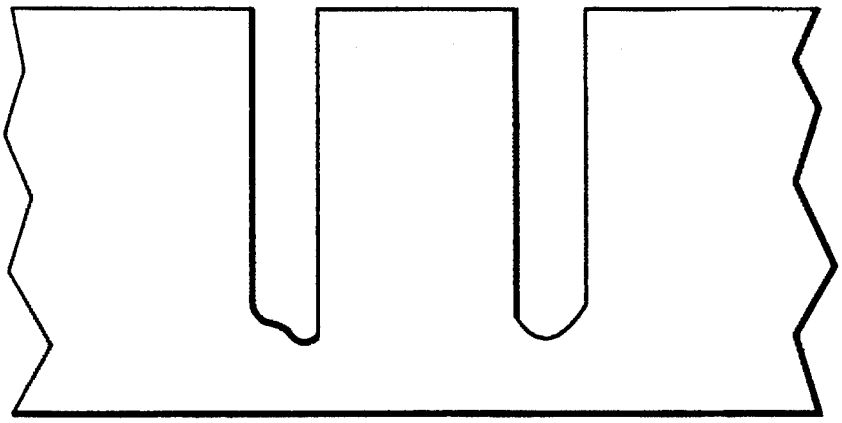
FIG. 4A shows asymmetric wear of a prior art blade.
Figure 4B:
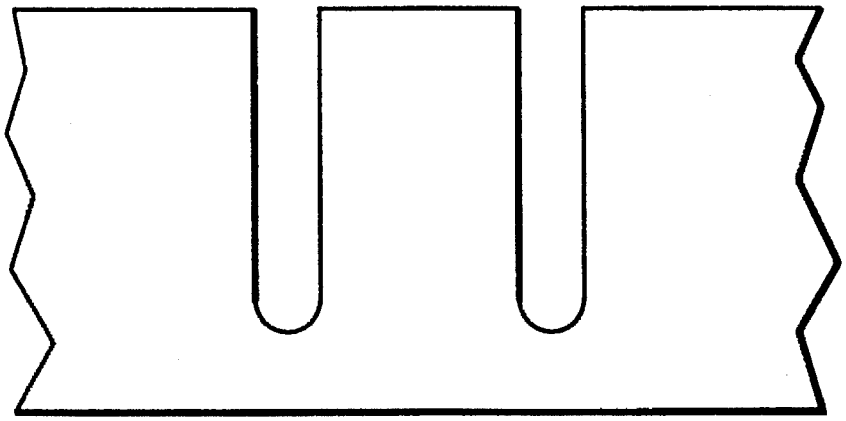
FIG. 4B shows a more symmetrical wear for the blade of the present invention.

12. Turn off platen heat and, after cooling, remove the sandwich 10' from between the platens and punch/die cut to the desired diameter. FIG. 3 shows the blade 30 cut to have an outside diameter $D_1$ of 4.7 inches and an inside diameter $D_2$ of 3.5 inches and with a thickness t of 0.011 inch. Blade 30 obtained in this process example demonstrated improved stiffness in wear with thickness controlled to about a 20 micron variation. Blade 30 accommodated saw feed rates of 3.175 mm per second. Since the blade is constructed layer by layer, it has a more consistent cross-section. The advantage of using graphite are its high module of elasticity helping to provide blade stiffness in thinner sections and a sufficient degree of electrical conductivity to enable ongoing blade height checks during sawing sequences. FIG. 4A shows an asymmetric blade wear typical of the resinold blade described in the '370 patent. FIG. 4B shows a symmetrical wear of blade 30 produced by the above process.

The die cut punch process described above and subsequent molding sometimes results in formation of burrs along the edge of the blade and undesirable thickness variations. According to another feature of the present invention, the blade edges are inspected for thickness. The blade edge is subjected to a lapping process wherein the blade is held down with a vacuum. An aluminum oxide abrasive stick is used to the remove the burrs and obtain the desired uniform thickness. Use of the lapping procedure reduces the thickness variations from 20 microns to 5 microns.

In the process steps described above, it would be appreciated that the graphite ring composition and the broadcasting of the diamond resin blend can be independently controlled. This enables several advantages and variations of the process. For example, since the area near the periphery of the blade (about 0.100 inch) is the active saw area, the diamond resin blend can be concentrated in this area with less of the blend being applied to the inner layer areas. The graphite veil can be formed with finer grit sizes in the outer periphery to complement the higher diamond resin concentration. Larger diamond grit sizes can be used for the inner portion of the veil. It is evident that each layer may be "tailored" as desired. The characteristics of each layer which can be altered are as follows:

1. graphite veil thickness
2. diamond grit size
3. resin/diamond blend concentration While the blade made by the above processes finds utility in the fabrication of ink jet printheads requiring wafer cutting and separation, the blade can also be used for a variety of precision cutting purposes. For example, the blades can be used during the fabrication of electrical semiconductor chips or for constructing raster input scan (RIS) sensor bars and also in the construction of magnetic heads. As a further example, while four layers have been disclosed producing a dicing blade 30, fewer or greater number of layers may be assembled to produce a blade. For some applications, two layers may suffice, for others, five or more may be required.

While graphite is a preferred material for the veil, other materials capable of being constructed as a non-woven fabric and having the desired electrical conductivity and mechanical properties may be used. A relatively high tensile modulus is necessary to impart the necessary strength to the blade; graphite has a 50 million psi, boron has a 55 million psi and steel at 30 million psi are all suitable materials.

While the embodiment disclosed herein is preferred, it will be appreciated from this teaching that various alternative, modifications, variations or improvements therein may be made by those skilled in the art, which are intended to be encompassed by the following claims:

What is claimed:

1. A composite resinold diamond blade comprising:

a ring shaped veil of a non-woven fabric material permeated with a mix of diamond particles blended into a phenolic resin to form a first layer of said blade and at least a second layer overlying said first layer, said second layer constituting a non-woven fabric material permeated with a mix of diamond resin blended into a phenol resin, said first and second layers compressed to form said composite resinold/diamond blade.

2. The blade of claim 1 wherein said fabric material is graphite.

3. The blade of claim 1 wherein at least one layer has a greater concentration of the diamond/resin mixture at the blade periphery.

4. The blade of claim 1 wherein said diamond particles have a mean particle size of 6.0 microns.

5. The blade of claim 4 wherein said resin to diamond mixture ratio is 4 grams/resin to 6 grams/diamond.

6. The blade of claim 2 wherein said graphite is at ¾ oz/sq. yd. fabrication having a thickness of approximately 0.008 inch.

7. The blade of claim 1 wherein the composite blade is formed of four compressed layers.

8. The blade of claim 1 wherein the non-woven fabric material has a tensile modulus of between 30 and 55 million psi.

* * * * *